United States Patent [19]

Courvoisier et al.

[11] 4,402,895

[45] Sep. 6, 1983

[54] PROCESS FOR THE PRODUCTION OF CARBURIZING AGENTS AND PRODUCTS

[75] Inventors: Peter Courvoisier, Willich; Dieter Stadie, Essen, both of Fed. Rep. of Germany

[73] Assignee: Verkaufsgesellschaft für Teererzeugnisse (VfT) mbH, Essen, Fed. Rep. of Germany

[21] Appl. No.: 333,589

[22] Filed: Dec. 23, 1981

[30] Foreign Application Priority Data

Jan. 13, 1981 [DE] Fed. Rep. of Germany ..... 3100727

[51] Int. Cl.[3] ..... C04B 15/14; C08L 1/08; C09C 1/56

[52] U.S. Cl. ..... 264/109; 106/193 R; 106/307; 264/117; 264/142; 264/210.1; 423/460

[58] Field of Search ..... 106/193, 307; 264/109, 264/117, 210.1; 252/444; 423/460

[56] References Cited

U.S. PATENT DOCUMENTS

| | | | |
|---|---|---|---|
| 3,186,928 | 6/1965 | Keaton et al. | 106/307 |
| 3,743,526 | 7/1973 | Zwahlen | 106/193 |
| 3,844,809 | 10/1974 | Murry | 106/307 |
| 4,308,073 | 12/1981 | Mills | 252/444 |

OTHER PUBLICATIONS

Chemical Abstracts 87:153,532w, 1977, Katayose.
Chemical Abstracts 90:7905r, Kawamoto, 1979.

*Primary Examiner*—Theodore Morris
*Attorney, Agent, or Firm*—Beveridge, DeGrandi & Kline

[57] ABSTRACT

The described process relates to the production of carburizing agents by compacting carbon dusts with a binder, such as hydroxyethyl cellulose, with addition of water and an auxiliary gelling agent. The auxiliary gelling agents used is glyoxal and/or bases of an alkali metal or alkaline earth metal or ammoniacal water. At from 0.5 to 2% by weight the requirement of binder is so small that no noticeable changes in the analytical values for the carbon dust used appear. The molded bodies produced from the compositions are dried at from 20° to 180° C. Calcination is not required.

9 Claims, No Drawings

PROCESS FOR THE PRODUCTION OF CARBURIZING AGENTS AND PRODUCTS

The invention relates to a process for the production of high-grade carburizing agents by compacting carbon dusts with a binder, and products.

Carburizing agents are added to the melts in the iron and steel industry for increasing the carbon content. For this purposes, crushed, classified carbon-containing raw materials, such as anthracite, pitch coke and petroleum coke, as well as graphite scrap, are usually employed. In the production of these carburizing agents, an undersize material having a particle diameter of less than 1 mm accumulates in the order of 50%. Because on the one hand of the analytical requirements, especially in making steel, particularly high-grade and therefore expensive raw materials have to be frequently used; i.e. which have a low content of harmful ingredients, such as sulphur, nitrogen, hydrogen etc, and because on the other hand, the undersize material cannot be directly used as a carburizing agent, there has been no lack of attempts at compacting this undersize material. Apart from the undersize material, other carbon dusts, such as, for example, waste carbon black, arising in chemical processes, are also processed to high-grade carburizing agents.

Following the production of briquettes, the use of pitches, bitumens and waste sulphite lyes as binders for carbon dusts is known. Addition of from 5% to 10% of coal tar pitch, however, leads to unacceptably high volatile contents in the carburizing agent, so that the latter has to be calcined at high temperatures prior to use. As a result, the process becomes uneconomical, especially if expensive raw materials are used.

This also applies to the use of bitumens, in which case moreover, the increase in the sulphur content must also be taken into account. Calcination becomes unnecessary when waste sulphite lye is used, and can be replaced by simple drying, but, because of the high sulphur content, the molded bodies cannot be used as carburizing agents.

Furthermore, attempts have been made to compact carbon dusts with water glass, so as to avoid the calcination step. Water glass however increases the ash content of the carburizing agents and is therefore unsuitable as a binder. There is the further point that these ashes form reactive slags, which attack the lining of the smelting furnaces.

Still further, it is known to work with starch-based binders. Such carburizing agents are used; e.g. for the case-hardening of steels. However, the abrasion resistance of the pellets is inadequate.

The object of this invention is, therefore, to discover a simple, inexpensive process for the production of granular high-purity carburizing agents from carbon dusts, in which the analytical values are only insignificantly changed with respect to those of the dusts and which leads to molded bodies having high abrasion resistance.

This problem was solved according to the invention by using as binder from 0.5 to 2% by weight, related to carbon dust, of hydroxyethyl cellulose, which, prior to compacting, with a carbon dust having a particle diameter of less than 2 mm, is homogenized in a mixer for from 5 to 20 minutes with addition of from 10 to 25% by weight of water and auxiliary gelling agent, and by compacting the composition thus obtained by extrusion, briquetting or pelleting to molded bodies of a size of from 3 to 15 mm, which are subsequently dried at from 80° to 180° C. for from 5 to 20 hours.

As gelling agents there are employed at least 20% by weight of glyoxal, related to the hydroxyethyl cellulose, and/or bases of an alkali metal or alkaline earth metal or ammoniacal water in a quantity of from 1 to 5% by weight, related to the hydroxyethyl cellulose, in the case of a 10% base. Glyoxal crosslinks the hydroxyethyl cellulose and thus causes the carburizing agent to become insensitive towards moisture. The base has an accelerating effect on the gelling process.

Preferably, the hydroxyethyl cellulose is mixed dry with the carbon dust. Only then the remaining components are added as aqueous solutions. It is however equally possible to allow the hydroxyethyl cellulose to swell in from 10-fold to 20-fold quantity of water and to mix it subsequently with the remaining components. All mixers customary for these purposes may be employed as mixing units; plough blade mixers have proved to be particularly useful.

When the mixing process has been finished, the composition can be directly processed to molded bodies from the mixer by extrusion, briquetting or pelleting. Apart from other known devices, an edge runner press in particular, is suitable for this purpose the matrix of which possesses cylindrical drillings having a diameter of from 3 to 8 mm. As a result of friction, the matrix and therefore also the pressed bodies heat up, so that part (ca. 5%) of the water evaporates. The temperature of the matrix must not exceed 70° C., however, because the composition otherwise dries too much and obstructs the drillings in the matrix.

The following examples are to show the advantages of the carburizing agents, produced in accordance with the invention, without limiting the invention.

EXAMPLE 1

320 parts by weight of fine grade graphite, (particle size less than 2 mm, analysis in Table I), are mixed with 3 parts by weight of 40% aqueous glyoxal solution and 7 parts by weight of water for 2 minutes in a plough blade mixer.

Thereafter, 3 parts by weight of hydroxyethyl cellulose, dissolved in 70 parts by weight of water after a swelling time of 6 minutes, are added to the mixture. After a mixing time of an additional 3 minutes, this composition is pressed on an edge runner press, having a matrix thickness of 35 mm and cylindrical drillings of 5 mm diameter. The pressed bodies are dried in a shelf dryer for 5 hours at 150° C. The properties of the carburizing agents thus obtained are shown in Table II in comparison to the values specified by steel producers. The abrasion resistance is ascertained on a laboratory sieving machine, equipped with 2 sieves, (mesh aperture width 1.0 and 0.5 mm), at a running time of 1 minute. What is determined is the residue on, and the passage through, the 0.5 mm sieve, (particle size 0.5) 1.0 mm and less than 0.5 mm.

EXAMPLE 2

340 parts by weight of fine grade graphite as in Example 1 are mixed dry for 2 minutes with 3 parts by weight of hydroxyethyl cellulose. Then 65 parts by weight of water are added and the whole mixed for 5 minutes. Finally, 0.06 parts by weight of 10% caustic soda solution is also sprayed into the mixer. After a further 2 minutes, the mixing process is concluded. Pressed bodies are formed from the composition as in Example 1 and dried for 5 hours at 150° C. The properties of the carburizing agent are listed in Table II.

EXAMPLE 3 (Comparative example)

300 parts by weight of fine grade graphite as in Example 1 are mixed for 10 minutes with a solution, made up of 45 parts by weight of water and 20 parts by weight of soda water glass, having a density of 1.36 g/cm$^3$ and a ratio of $SiO_2$ to $Na_2O$ of 3.35. Pressed bodies are formed from the composition as in Example 1 and are dried for 5 hours at 150° C. Theproperties of the carburizing agent are listed in Table II by way of comparison.

EXAMPLE 4 (Comparative example)

297 parts by weight of fine grade graphite as in Example 1 are mixed for 10 minutes with 8 parts by weight of waste sulphite lye (density: 1.2 g/cm$^3$) and 53.4 parts by weight of water. The composition is shaped to pressed bodies as in Example 1, which are similarly dried for 5 hours at 150° C. The properties of the pressed bodies are listed in Table II for comparison.

EXAMPLE 5 (Comparative example)

297 parts by weight of fine grade graphite as in Example 1 are mixed dry for 2 minutes with 3 parts by weight of starch binder. Then 60 parts by weight of water at 20° C. are added. After a mixing time of a further 5 minutes, the composition is processed to pressed bodies as in Example 1, which are dried for 5 hours at 150° C. The properties are listed in Table II for comparison.

TABLE I

| Analysis of the fine grade graphite | |
|---|---|
| carbon content | 99.2% |
| hydrogen content | 0.013% |
| nitrogen content | 0.05% |
| sulphur content | 0.02% |
| volatile matter | 0.57% |
| ash | 0.15% |
| moisture | 0.2% |

The percentage data are to be taken as % by weight.

TABLE II

| Properties and Analytical Data of Carburizing Agent | | | | | | |
|---|---|---|---|---|---|---|
| | | carburizing agent according to | | | | |
| | specified values | Example 1 | Example 2 | Example 3 | Example 4 | Example 5 |
| carbon content (%) | min. 98 | 99.0 | 98.09 | 91.90 | 95.10 | 97.31 |
| hydrogen content (%) | max. 0.3 | 0.12 | 0.06 | 0.07 | 0.44 | 0.06 |
| nitrogen content (%) | max. 0.3 | 0.05 | 0.05 | 0.05 | 0.05 | 0.05 |
| sulphur content (%) | max. 0.3 | 0.07 | 0.14 | 0.12 | 0.52 | 0.16 |
| volatile matter (%) | max. 1.0 | 0.96 | 0.89 | 1.13 | 1.80 | 1.56 |
| ash (%) | max. 1.0 | 0.7 | 0.70 | 5.86 | 0.98 | 1.51 |
| moisture (%) | max. 0.6 | 0.2 | 0.1 | 0.1 | 0.1 | 0.1 |
| abrasion resistance | | | | | | |
| 0.5–1.0 mm (%) | max. 1.5 | 0.5 | 0.2 | 4.6 | 0.4 | 19.0 |
| <0.5 mm (%) | max. 1.0 | 0.3 | 0.0 | 1.7 | 0.2 | 2.0 |

We claim:

1. A process for the production of carburizing agents comprising compacting carbon dust having a particle diameter of less than 2 mm with a binder, wherein the binder used is from 0.5 to 2% by weight, related to carbon dust, of hydroxyethyl cellulose, which, prior to compacting with carbon dust is homogenized from 5 to 20 minutes, with addition of from 10 to 25% by weight of water and auxiliary gelling agent, said compacting being carried out by extrusion, briquetting or pelleting to thereby obtain molded bodies, having a size of from 3 to 15 mm, and subsequently drying said bodies for 5 to 20 hours at 80° to 180° C.

2. The process according to claim 1, wherein glyoxal is used in a quantity of at least 20%, related to hydroxyethyl cellulose, as auxiliary gelling agent for crosslinking the hydroxyethyl cellulose.

3. The process according to claims 1 or 2, wherein a base of an alkali metal or alkaline earth metal or ammoniacal water is used as an additional auxiliary gelling agent.

4. The process according to claims 1 or 2, wherein the carbon dust is pre-mixed dry with hydroxyethyl cellulose.

5. The process according to claims 1 or 2, wherein the hydroxyethyl cellulose swells in from 10-fold to 20-fold quantity of water for from 5 to 10 minutes and is then mixed with the remaining components.

6. The process according to claims 1 or 2, wherein the components are homogeneously mixed in a plough blade mixer.

7. The process according to claims 1 or 2, wherein the compacting is carried out in an edge runner press, the matrix of which possesses cylindrical drillings, having a diameter of from 3 to 8 mm, at a temperature of less than 70° C.

8. A shaped, compacted carburizing agent product comprising carbon dust and a binder, wherein said carbon dust has a particle diameter of less than 2 mm, said binder is from 0.5 to 2% by weight, related to carbon dust, of hydroxyethyl cellulose, which, prior to compacting with carbon dust, having been homogenized in a mixer for from 5 to 20 minutes, with addition of from 10 to 25% by weight of water and an auxiliary gelling agent.

9. A composition for producing a carburizing agent comprising carbon dust a binder, said carbon dust having a particle diameter of less than 2 mm, said binder being from 0.5 to 2% by weight, related to the carbon dust, of hydroxyethyl cellulose, said binder being homogenized with 10 to 25% by weight of water and an auxiliary gelling agent.

* * * * *